US011671760B2

(12) United States Patent
Song et al.

(10) Patent No.: US 11,671,760 B2
(45) Date of Patent: Jun. 6, 2023

(54) SPEAKER DEVICE

(71) Applicant: AAC Microtech (Changzhou) Co., Ltd., Changzhou (CN)

(72) Inventors: Wei Song, Shenzhen (CN); Bo Xiao, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/535,505

(22) Filed: Nov. 24, 2021

(65) Prior Publication Data

US 2022/0174411 A1 Jun. 2, 2022

(30) Foreign Application Priority Data

Nov. 30, 2020 (CN) ..... 202011381261.4

(51) Int. Cl.
*H04R 9/02* (2006.01)
*H04R 7/16* (2006.01)
*H04R 9/04* (2006.01)

(52) U.S. Cl.
CPC ..... *H04R 9/025* (2013.01); *H04R 7/16* (2013.01); *H04R 9/04* (2013.01)

(58) Field of Classification Search
CPC ... H04R 9/06; H04R 7/04; H04R 9/04; H04R 9/025; H04R 7/16; H04R 1/021; H04R 1/288; H04R 1/345; H04R 31/006; H04R 2499/11; H04R 1/026; H04R 1/06; H04R 9/02; H04R 7/20; H04R 1/2803; H04R 7/127
USPC ..... 381/409, 424, 395, 412, 396, 388, 333, 381/386
See application file for complete search history.

(56) References Cited

U.S. PATENT DOCUMENTS

2011/0085694 A1* 4/2011 Lee ..... H04R 9/022 381/397
2014/0294225 A1* 10/2014 Ji ..... H04R 1/023 381/386
2018/0270555 A1* 9/2018 Mao ..... H04R 1/023
2018/0302722 A1* 10/2018 Linghu ..... H04R 9/025
2021/0266674 A1* 8/2021 Li ..... H04R 9/02
2022/0038823 A1* 2/2022 Gao ..... H04R 9/06

* cited by examiner

*Primary Examiner* — Alexander Krzystan
*Assistant Examiner* — Julie X Dang
(74) *Attorney, Agent, or Firm* — W&G Law Group

(57) ABSTRACT

A speaker device includes: a housing provided with an accommodating space, and a sounding member accommodated in the accommodating space. The sounding member includes a magnetic circuit unit and a vibration unit provided with a diaphragm. The housing includes an upper housing and a lower housing. The lower housing includes: a metal bottom wall, lower metal side walls, and, and sealing connectors respectively provided between two adjacent lower metal side walls of the plurality of lower metal side walls. An end of the lower metal side wall close to the upper housing bends and extends in a direction perpendicular to a vibrating direction of the diaphragm to form a bending edge. The bending edge and a bottom surface of the sealing connectors jointly form a sealing surface. The sealing surface is connected to the upper housing to seal. The speaker device can increase the powder filling space.

5 Claims, 5 Drawing Sheets

A-A

B-B

SPEAKER DEVICE

TECHNICAL FIELD

The present disclosure relates to the technical field of speakers, and in particular, to a speaker device.

BACKGROUND

In the related art, a speaker device includes a housing provided with an accommodating space and a sounding member accommodated in the housing. The housing includes an upper housing and a lower housing that are assembled to form the accommodating space. The lower housing typically includes a plastic frame body and a metal shell covering the plastic frame body. The sounding member divides the accommodating space into a front chamber and a rear chamber. The rear chamber is defined by the lower housing, the sounding member and a part of the upper housing. Since the plastic frame body occupies the space of the rear chamber, the volume of the rear chamber is reduced, resulting in a small space for filling, which affects the acoustic performance of the speaker device.

Therefore, it is necessary to provide a speaker device to overcome the above defect.

SUMMARY

An objective of the present disclosure is to provide a speaker device, which can increase a powder filling space.

An aspect of the present disclosure provides a speaker device. The speaker device includes: a housing provided with an accommodating space, and a sounding member accommodated in the accommodating space. The sounding member includes a magnetic circuit unit and a vibration unit provided with a diaphragm. The housing includes an upper housing and a lower housing, the lower housing is assembled with the upper housing to form the accommodating space. The lower housing includes: a metal bottom wall, a plurality of lower metal side walls spaced apart from each other and bending and extending from the metal bottom wall, and sealing connectors respectively provided between two adjacent lower metal side walls of the plurality of lower metal side walls. An end of each of the plurality of lower metal side walls close to the upper housing bends and extends in a direction perpendicular to a vibrating direction of the diaphragm to form a bending edge, the bending edge and a bottom surface of each of the sealing connectors jointly form a sealing surface, and the sealing surface is connected to the upper housing to seal.

As an improvement, the metal bottom wall is a rectangular structure; the plurality of lower metal side walls bends and extends from four sides of the metal bottom wall toward the upper housing; the sealing connectors are respectively connected between two adjacent lower metal side walls of the plurality of lower metal side walls; and the bending edge is flush with the bottom surface of each of the sealing connectors.

As an improvement, the metal bottom wall includes a pair of long sides and a pair of short sides spaced apart from each other; and the plurality of lower metal side walls is a first side wall, a second side wall, a third side wall and a fourth side wall, the first side wall and the second side wall are connected to the pair of short sides respectively, and the third side wall and the fourth side wall are connected to the pair of long sides respectively; and the sealing connector include a pair of first connectors and a pair of second connectors; the pair of first connectors respectively connect the first side wall to the third side wall and connect the first side wall to the fourth side wall; and the pair of second connectors respectively connect the second side wall to the third side wall and connect the second side wall to the fourth side wall.

As an improvement, the first connector include a corner portion, a first fixing portion and a second fixing portion; the first fixing portion and the second fixing portion are formed by extending from two opposite ends of the corner portion and in a direction away from each other; and the first fixing portion is connected to the first side wall, and the second fixing portion is connected to the third side wall or the fourth side wall.

As an improvement, the second connector includes a connecting body, a first bending arm and a second bending arm, the first bending arm and the second bending arm bend and extend from the connecting body toward the accommodating space; the first bending arm and the second bending arm are spaced apart from each other; the first bending arm is fixedly connected to the second side wall; the connecting body is fixedly connected to the third side wall or the fourth side wall; and the second bending arm extends into the accommodating space.

As an improvement, the upper housing includes a top wall, an upper side wall bending and extending from an edge of the top wall, a sounding channel connected to the upper side wall, a bracket extending from the top wall toward the accommodating space, and a frame fixedly connected to the bracket; the sounding channel communicates with the accommodating space; and the sealing surface abuts against and is fixed to the upper side wall and the frame.

As an improvement, the diaphragm and the top wall are spaced apart from each other to form a front chamber; the front chamber communicates with the sounding channel; and the diaphragm is fixed between the frame and the bracket.

As an improvement, the sounding member, the upper housing and the lower housing jointly enclose a rear chamber; the speaker device further includes an air-permeable spacer located in the rear chamber; the air-permeable spacer is attached to the sounding member and fixedly connected to the bracket; and the air-permeable spacer, the bracket, the upper housing and the lower housing jointly enclose a powder filling space for being filled with a sound absorbing material.

The present disclosure has the following beneficial effects. With the above speaker device, the ends of the metal side walls of the lower housing are bent to form bending edges while providing plastic parts merely at four corners, the plastic parts are folded inward to form a sealing surface between the upper housing and the lower housing, so that the volume of the plastic parts is reduced, thereby increasing the powder filling space.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF EMBODIMENTS

The present disclosure is further described below with reference to the drawings and embodiments.

Figure 1:
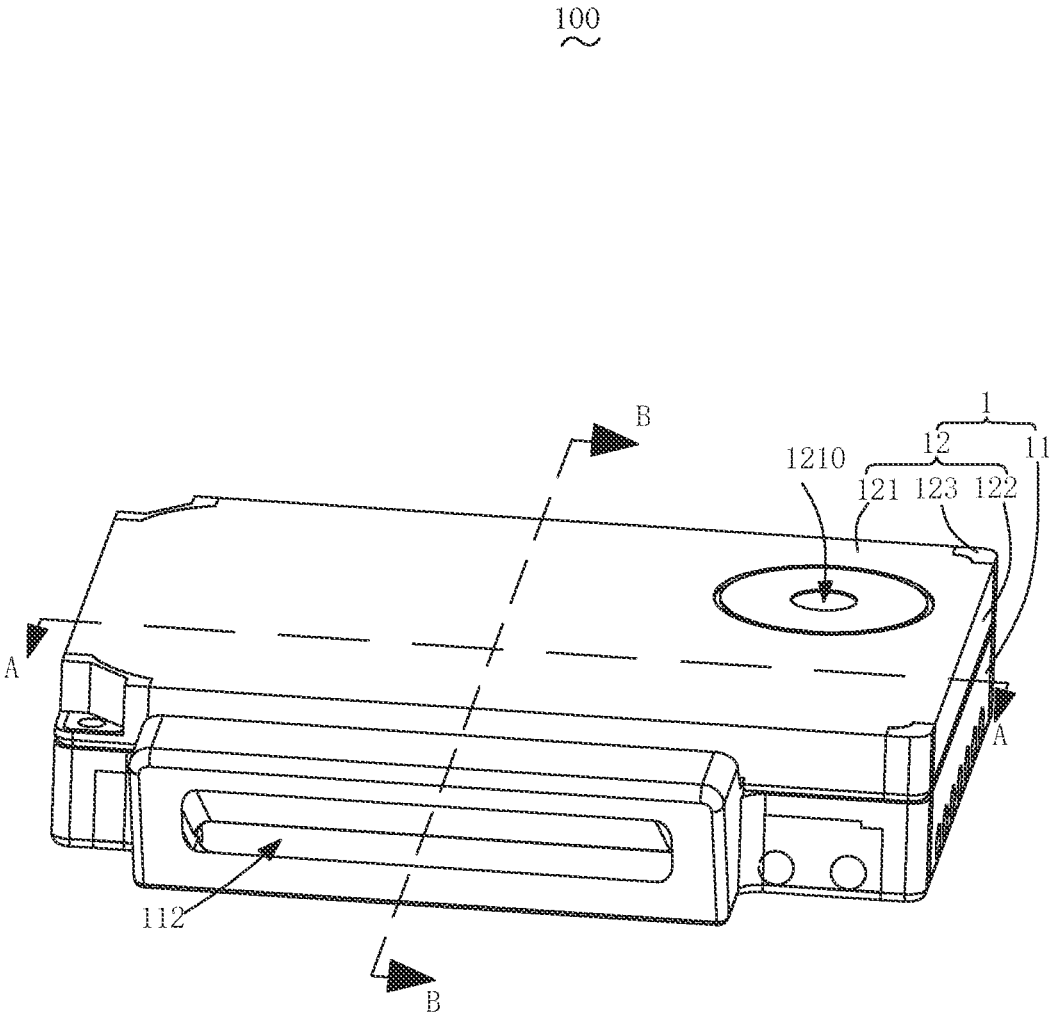
FIG. 1 is a three-dimensional view of a speaker device according to an embodiment of the present disclosure.
Figure 2:
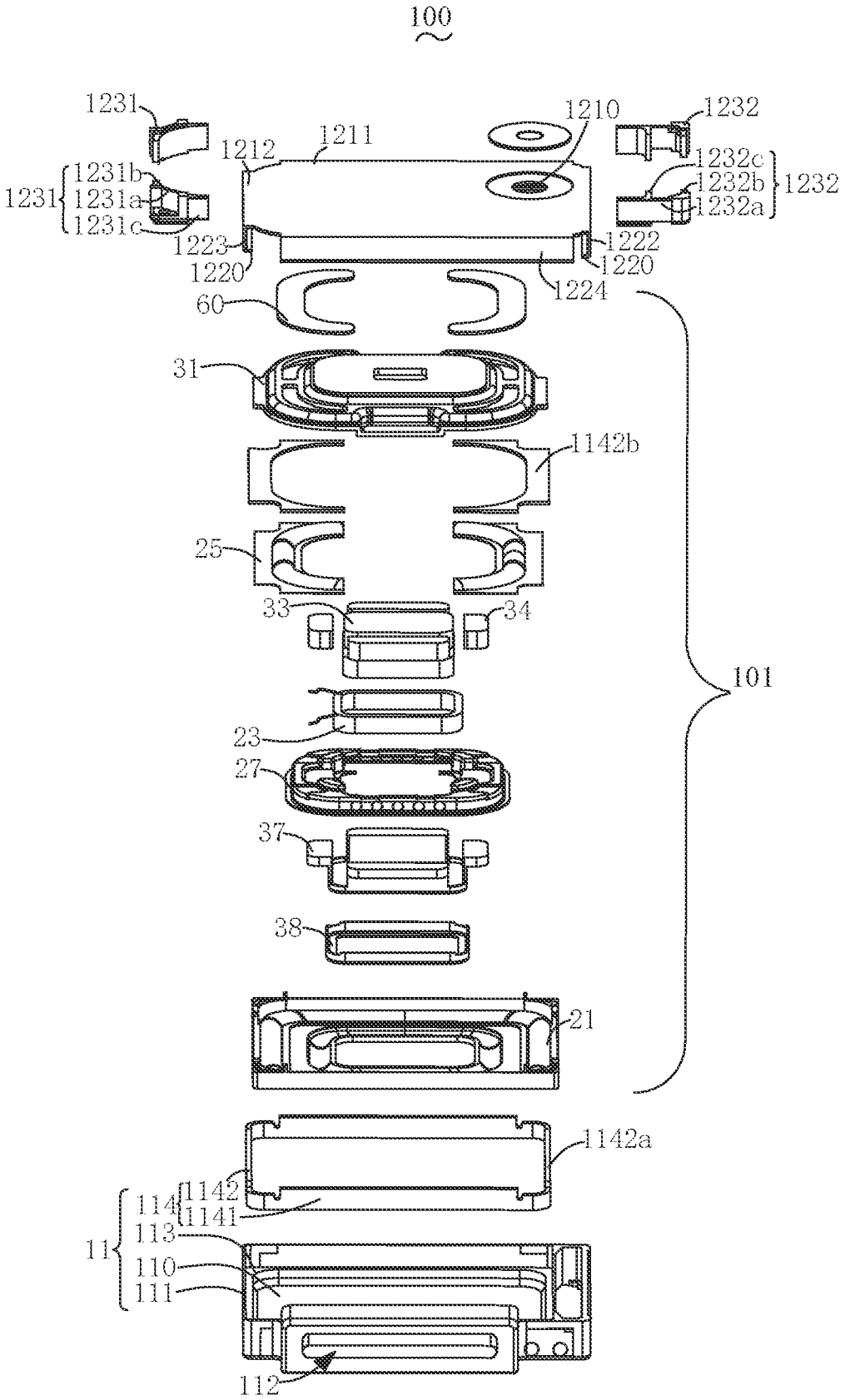
FIG. 2 is an exploded view of the speaker device shown in FIG. 1 according to an embodiment of the present disclosure.
Figure 3:
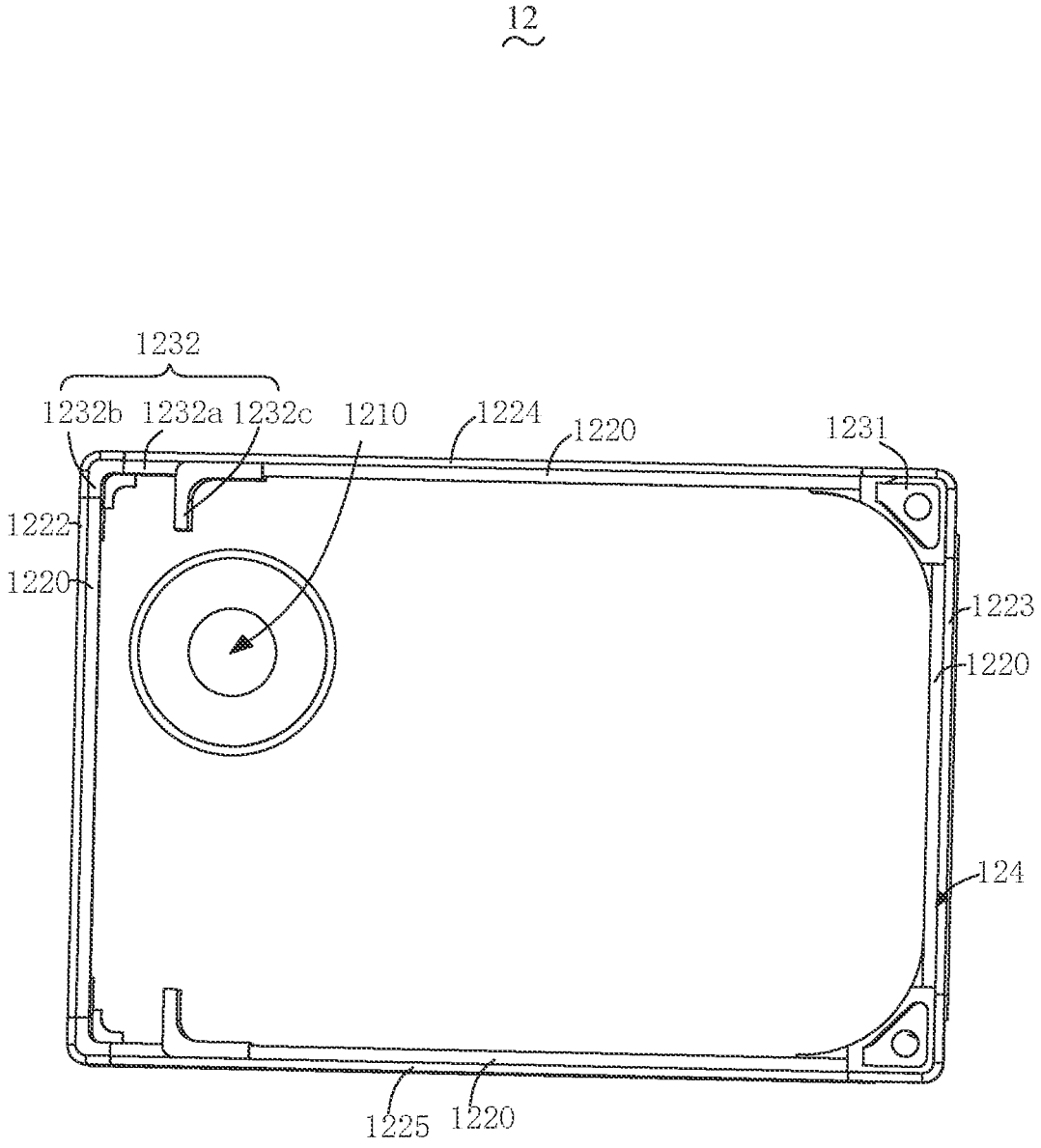
FIG. 3 is a three-dimensional view of a lower housing shown in FIG. 1 from another angle according to an embodiment of the present disclosure.
Figure 4:
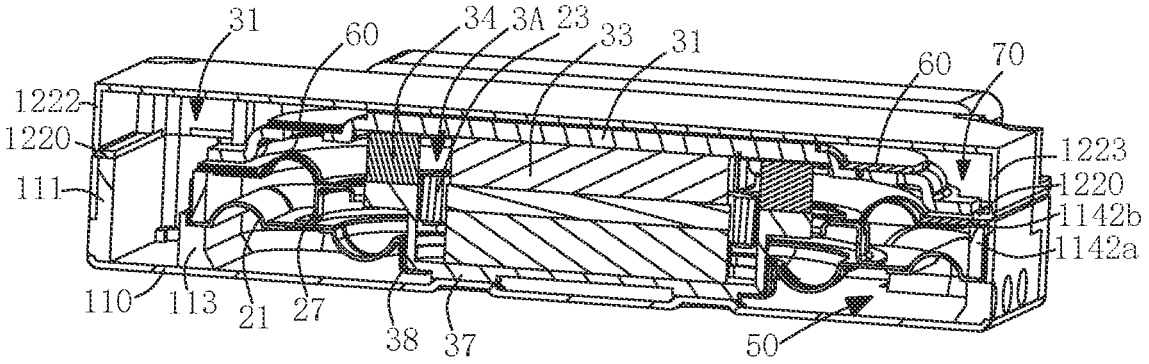
FIG. 4 is a cross-sectional view taken along line A-A shown in FIG. 1 according to an embodiment of the present disclosure.
Figure 5:
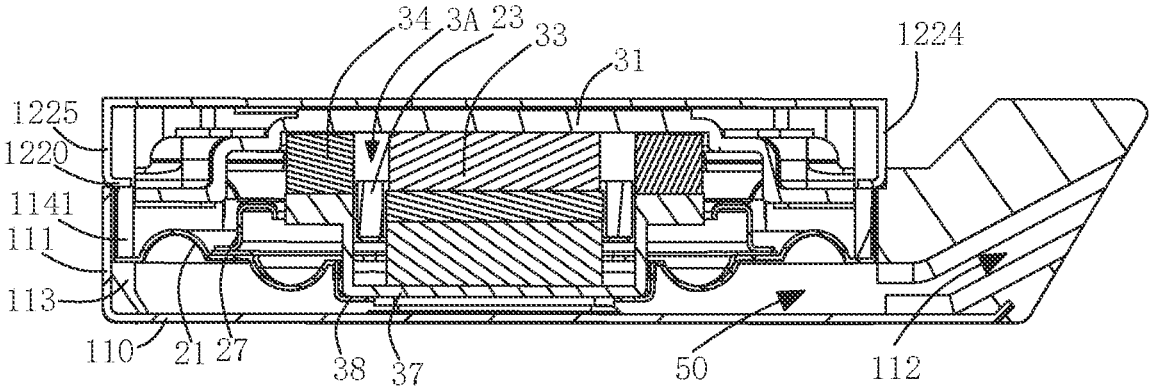
FIG. 5 is a cross-sectional view taken along line B-B shown in FIG. 1 according to an embodiment of the present disclosure.

Referring to FIG. 1 to FIG. 5, the present disclosure provides a speaker device 100. The speaker device includes: a housing 1 provided with an accommodating space, and a sounding member 101 accommodated in the housing. The sounding member 101 includes a vibration unit and a magnetic circuit unit. The vibration unit has a diaphragm 21.

The housing 1 includes an upper housing 11 and a lower housing 12. The upper housing 11 and the lower housing 12 are assembled with each other to form the accommodating space.

The lower housing 12 includes a metal bottom wall 121 that is substantially flat, a plurality of lower metal side walls 122, and a plurality of sealing connectors 123. The lower metal side walls 122 bend and extend from an edge of the metal bottom wall 121 toward the upper housing 11 and are spaced apart from each other. The sealing connector 123 is configured to connect two adjacent lower metal side walls 122. The sealing connector 123 is made of a plastic material, and is embedded with a metal conductor (not shown in the drawing) for electrical connection, so as to facilitate the electrical connection formed between an external circuit and the sounding member 101. An end of the lower metal side wall 122 close to the upper housing 11 bends and extends in a direction perpendicular to a vibrating direction of the diaphragm 21 to form a bending edge 1220. The bending edge 1220 and a bottom surface of the sealing connector 123 are jointly form a sealing surface 124. The bending edge 1220 is flush with the bottom surface of the sealing connector 123.

In an embodiment, the metal bottom wall 121 includes a pair of long sides 1211 and a pair of short sides 1212 that are respectively arranged oppositely and spaced apart from each other. The metal bottom wall 121 is provided with a powder filling hole 1210. In an embodiment, four lower metal side walls 122 are provided, including a first side wall 1222, a second side wall 1223, a third side wall 1224 and a fourth side wall 1225. The first side wall 1222 and a second side wall 1223 are formed by bending and extending from the pair of short sides 1212, respectively. The third side wall 1224 and a fourth side wall 1225 are formed by bending and extending from the pair of long sides 1211, respectively. The first side wall 1222 is opposite to the second side wall 1223. Two ends of the first side wall 1222 are spaced apart from one end of the third side wall 1224 and one end of the fourth side wall 1225, respectively. Two ends of the second side wall 1223 are spaced apart from the other end of the third side wall 1224 and the other end of the fourth side wall 1225, respectively.

In an embodiment, the lower housing 12 includes four sealing connectors 123, namely, a pair of first connectors 1231 connected between the first side wall 1222 and the third side wall 1224 and between the first side wall 1222 and the fourth side wall 1225, respectively, and a pair of second connectors 1232 connected between the second side wall 1223 and the third side wall 1224 and between the second side wall 1223 and the fourth side wall 1225, respectively.

In an embodiment, the first connectors 1231 each include a first corner portion 1231*a*, a first fixing portion 1231*b* and a second fixing portion 1231*c*. The first fixing portion 1231*b* and the second fixing portion 1231*c* extend from two opposite ends of the first corner portion 1231*a* by facing away from each other. The first fixing portion 1231*b* is connected to the first side wall 1222, and the second fixing portion 1231*c* is connected to the third side wall 1224 or the fourth side wall 1225.

The second connector 1232 includes a connecting body 1232*a*, a first bending arm 1232*b* and a second bending arm 1232*c*. The first bending arm 1232*b* and a second bending arm 1232*c* band and extend from the connecting body 1232*a* to the accommodating space. The first bending arm 1232*b* and the second bending arm 1232*c* are spaced apart from each other. The connecting body 1232*a* is connected to the third side wall 1224 or the fourth side wall 1225. The first bending arm 1232*b* is connected to the second side wall 1222, and the second bending arm 1232*c* extends into the accommodating space.

The upper housing 11 includes a top wall 110 that is substantially flat, an upper side wall 111 and a sounding channel 112. The upper side wall 111 bends and extends from the top wall 110. The sounding channel 112 is connected to the upper side wall 111. The sounding channel 112 communicates with the accommodating space.

The upper housing 11 further includes a bracket 113 and a frame 114. The bracket 113 extends from the top wall 110 to the lower housing 12. The frame 114 is fixedly connected to the bracket 113. The bracket 113 has a ring shape. The upper housing 11, the bracket 113, the frame 114 and the lower housing 12 enclose a rear chamber 70. The upper housing 11 abuts against and is fixed to the sealing surface 124 of the lower housing 12 to seal the rear chamber 70.

The frame 114 has roughly a ring shape, and includes a pair of long axis sides 1141 spaced-apart and a pair of short axis sides 1142 spaced-apart. The short axis side 1142 includes a first extension arm 1142*a* and a second extension arm 1142*b*. The first extension arm 1142*a* extends along the vibrating direction. The second extension arm 1142*b* is connected to the first extension arm 1142*a* and extends toward the magnetic circuit unit 30. In an embodiment, a long axis side 1141 of the frame 114 abuts against and is fixed to the bending edge 1220 of the third side wall 1224 and the bottom surface of a corresponding sealing connector 123, respectively. The bending edge 1220 of the first side wall 1222 and the bottom surface of a corresponding sealing connector 123 abut against and are fixed to the upper side wall 111 of the upper housing 11. The bending edge 1220 of the second side wall 1223 and the bottom surface of a corresponding sealing connector 123 abut against and are fixed to the second extension arm 1142*b* of the frame 114.

The vibration unit 20 includes a diaphragm 21, a voice coil 23, elastic support members 25, and a holder 27. The diaphragm 21 is fixed to the frame 114. The voice coil 23 drives the diaphragm 21 to vibrate and produce sound. The elastic support members 25 are spaced apart from the diaphragm 21. One end of the elastic support member 25 is fixed to the frame 114, and the other end of the elastic support member 25 is fixed to the holder 27. The voice coil 23 is fixed to the holder 27. The voice coil 23 is electrically connected to an external circuit. After the voice coil 23 is energized, the voice coil 23 vibrates under the action of a magnetic field of the magnetic circuit unit 30. Meanwhile, the voice coil 23 drives the diaphragm 21 to vibrate. The diaphragm 21 is spaced apart from the top wall 110 to form a front chamber 50. The front chamber 50 communicates with the sounding channel 112 to emit sound.

The magnetic circuit unit 30 includes a yoke 31, a main magnetic portion 33 and a plurality of auxiliary magnetic portions 34. The yoke is fixed to the frame 114. The main magnetic portion 33 and the plurality of auxiliary magnetic portions 34 are fixed to the yoke 31. The auxiliary magnetic portions 34 surround the main magnetic portion 33 and are spaced apart from the main magnetic portion 33 to form a magnetic gap 3A. The magnetic circuit unit 30 further includes a splint 37. The splint 37 is fixed to a side of the main magnetic portion 33 and the auxiliary magnetic portion 34 facing away from the yoke 31. The yoke 31 is fixed to the second extension arm 1142*b* of the frame 114.

The magnetic circuit unit 30 further includes a fixing member 38 sleeved outside the splint 37. The fixing member 38 is used to connect the diaphragm 21 to the splint 37.

The speaker device 100 further includes an air-permeable spacer 60 located in the rear chamber 70. The air-permeable spacer 60 is attached to the yoke 31. The air-permeable spacer 60, the yoke 31, the lower housing 12, the bracket 113 and the upper housing 11 jointly enclose a powder filling space 31. The powder filling space 31 communicates with the powder filling hole 1210.

Compared with the related art, in the present disclosure, the plastic part of the lower housing is reduced, and the bending edges of the lower housing are connected to the upper housing to form a sealing surface, thereby increasing the volume of the rear chamber that can be used for powder filling.

It should be understood that, in the description of the present disclosure, the terms such as "central", "longitudinal", "transverse", "long", "wide", "thick", "upper", "lower", "front", "back", "left", "right", "vertical", "horizontal", "top", "bottom", "inner", "outer", "clockwise", "anticlockwise", "axial", "radial" and "circumferential" are intended to indicate orientations shown in the drawings. It should be noted that these terms are merely intended to facilitate a simple description of the present disclosure, rather than to indicate or imply that the mentioned apparatus or elements must have the specific orientation or be constructed and operated in the specific orientation. Therefore, these terms may not be construed as a limitation to the present disclosure.

Moreover, the terms such as "first" and "second" are used only for the purpose of description and should not be construed as indicating or implying a relative importance, or implicitly indicating a quantity of indicated technical features. Therefore, features defined by "first" and "second" may explicitly or implicitly include at least one of the features. In the description of the present disclosure, "a plurality of" means at least two, for example, two or three, unless otherwise clearly and specifically limited.

In the present disclosure, unless otherwise clearly specified, the terms such as "mounting", "interconnection", "connection" and "fixation" are intended to be understood in a broad sense. For example, the "connection" may be a fixed connection, removable connection or integral connection; may be a mechanical connection or electrical connection; may be a direct connection or indirect connection using a medium; and may be a communication or interaction between two elements. Those skilled in the art may understand the specific meanings of the above terms in the present disclosure based on specific situations.

In the present disclosure, unless otherwise explicitly stipulated, "a first feature is above or below a second feature" may indicate that "the first and second features are in direct contact" or "the first and second features are in indirect contact through an intermediate feature". In addition, when it is described that the first feature is "over", "above" and "on" the second feature, it indicates that the first feature is directly or obliquely above the second feature, or simply indicates that an altitude of the first feature is higher than that of the second feature. When it is described that a first feature is "under", "below" or "beneath" a second feature, it indicates that the first feature is directly or obliquely under the second feature or simply indicates that the first feature is lower than the second feature.

It should be noted that when a component is "fixed" or "provided" on the other component, the component may be fixed on the other component directly or via an intermediate component. When a component is connected with the other component, the component may be connected with the other component directly or via an intermediate component. The terms "vertical", "horizontal", "upper", "lower", "left", "right" and other similar expressions used herein are for illustrative purposes only, rather than to mean the only embodiment.

The technical characteristics of the above embodiments can be employed in arbitrary combinations. In an effort to provide a concise description of these embodiments, all possible combinations of all technical characteristics of the embodiments may not be described; however, these combinations of technical characteristics should be construed as disclosed in the description as long as no contradiction occurs.

The above embodiments are merely illustrative of several embodiments of the present disclosure, and the description thereof is specific and detailed. However, these embodiments may not be construed as a limitation to the patentable scope of the present disclosure. It should be pointed out that several variations and improvements may be made by those skilled in the art without departing from the conception of the present disclosure, but such variations and improvements should fall within the protection scope of the present disclosure. Therefore, the patent protection scope of the present disclosure should be defined by the appended claims.

What is claimed is:

1. A speaker device, comprising:

a housing provided with an accommodating space; and a sounding member accommodated in the accommodating space, wherein the sounding member comprises a magnetic circuit unit and a vibration unit provided with a diaphragm;

the housing comprises an upper housing and a lower housing, the lower housing is assembled with the upper housing to form the accommodating space;

the lower housing comprises: a metal bottom wall, a plurality of lower metal side walls spaced apart from each other and bending and extending from the metal bottom wall, and sealing connectors respectively provided between two adjacent lower metal side walls of the plurality of lower metal side walls;

an end of each of the plurality of lower metal side walls close to the upper housing bends and extends in a direction perpendicular to a vibrating direction of the diaphragm to form a bending edge, the bending edge and a bottom surface of each of the sealing connectors jointly form a sealing surface, and the sealing surface is connected to the upper housing to seal;

the metal bottom wall is a rectangular structure, the plurality of lower metal side walls bends and extends from four sides of the metal bottom wall toward the upper housing, the sealing connectors are respectively connected between two adjacent lower metal side walls of the plurality of lower metal side walls, the bending edge is flush with the bottom surface of each of the sealing connectors;

the metal bottom wall comprises a pair of long sides and a pair of short sides spaced apart from each other, the plurality of lower metal side walls is a first side wall, a second side wall, a third side wall and a fourth side wall, the first side wall and the second side wall are connected to the pair of short sides respectively, the third side wall and the fourth side wall are connected to the pair of long sides respectively;

the sealing connector comprise a pair of first connectors and a pair of second connectors, the pair of first connectors respectively connect the first side wall to the third side wall and connect the first side wall to the fourth side wall, the pair of second connectors respectively connect the second side wall to the third side wall and connect the second side wall to the fourth side wall;

the first connector comprise a corner portion, a first fixing portion and a second fixing portion, the first fixing portion and the second fixing portion are formed by extending from two opposite ends of the corner portion and in a direction away from each other, the first fixing portion is connected to the first side wall, the second fixing portion is connected to the third side wall or the fourth side wall.

2. The speaker device as described in claim 1, wherein the second connector comprises a connecting body, a first bending arm and a second bending arm, the first bending arm and the second bending arm bend and extend from the connecting body toward the accommodating space; the first bending arm and the second bending arm are spaced apart from each other; the first bending arm is fixedly connected to the second side wall; the connecting body is fixedly connected to the third side wall or the fourth side wall; and the second bending arm extends into the accommodating space.

3. The speaker device as described in claim 1, wherein the upper housing comprises a top wall, an upper side wall bending and extending from an edge of the top wall, a sounding channel connected to the upper side wall, a bracket extending from the top wall toward the accommodating space, and a frame fixedly connected to the bracket; the sounding channel communicates with the accommodating space; and the sealing surface abuts against and is fixed to the upper side wall and the frame.

4. The speaker device as described in claim 3, wherein the diaphragm and the top wall are spaced apart from each other to form a front chamber; the front chamber communicates with the sounding channel; and the diaphragm is fixed between the frame and the bracket.

5. The speaker device as described in claim 3, wherein the sounding member, the upper housing and the lower housing jointly enclose a rear chamber; the speaker device further comprises an air-permeable spacer located in the rear chamber; the air-permeable spacer is attached to the sounding member and fixedly connected to the bracket; and the air-permeable spacer, the bracket, the upper housing and the lower housing jointly enclose a powder filling space for being filled with a sound absorbing material.

* * * * *